US008325032B2

(12) United States Patent
Pan

(10) Patent No.: US 8,325,032 B2
(45) **Date of Patent: *Dec. 4, 2012**

(54) MINIATURE LIFE-SAVING DEVICE

(76) Inventor: Yang Pan, Shanghai (CN)

( * ) Notice: Subject to any disclaimer, the term of this patent is extended or adjusted under 35 U.S.C. 154(b) by 490 days.

This patent is subject to a terminal disclaimer.

(21) Appl. No.: 12/626,900

(22) Filed: Nov. 29, 2009

(65) Prior Publication Data

US 2011/0128147 A1 Jun. 2, 2011

(51) Int. Cl.
*G08B 1/08* (2006.01)

(52) U.S. Cl. ..... 340/539.13; 340/539.11; 340/539.12

(58) Field of Classification Search ..... 340/539.13, 340/539.12, 539.11
See application file for complete search history.

(56) References Cited

U.S. PATENT DOCUMENTS

| | | | | |
|---|---|---|---|---|
| 6,314,308 | B1 | 11/2001 | Sheynblat et al. | |
| 6,668,179 | B2 | 12/2003 | Jiang | |
| 6,786,866 | B2 * | 9/2004 | Odagiri et al. | 600/300 |
| 7,058,409 | B2 | 6/2006 | Hanninen et al. | |
| 7,251,470 | B2 | 7/2007 | Faucher et al. | |
| 7,905,832 | B1 * | 3/2011 | Lau et al. | 600/300 |
| 2003/0129977 | A1 | 7/2003 | Dolwin | |
| 2004/0224659 | A1 | 11/2004 | Cheng | |
| 2004/0263338 | A1 | 12/2004 | Katz | |
| 2004/0266349 | A1 | 12/2004 | Wang | |
| 2005/0037730 | A1 | 2/2005 | Montague | |
| 2006/0247560 | A1 * | 11/2006 | Halperin et al. | 601/41 |
| 2006/0253894 | A1 * | 11/2006 | Bookman et al. | 726/2 |
| 2006/0273916 | A1 * | 12/2006 | Ortelle | 340/574 |
| 2007/0004379 | A1 | 1/2007 | Stanners | |
| 2007/0270164 | A1 | 11/2007 | Maier et al. | |
| 2007/0276270 | A1 * | 11/2007 | Tran | 600/508 |
| 2008/0125288 | A1 * | 5/2008 | Case | 482/1 |
| 2008/0312565 | A1 * | 12/2008 | Celik-Butler et al. | 601/43 |
| 2009/0118595 | A1 * | 5/2009 | Greiner et al. | 600/301 |
| 2009/0174547 | A1 | 7/2009 | Greene et al. | |
| 2009/0224890 | A1 * | 9/2009 | Kim | 340/10.33 |
| 2010/0274100 | A1 * | 10/2010 | Behar et al. | 600/301 |

* cited by examiner

*Primary Examiner* — Jennifer Mehmood
*Assistant Examiner* — Andrew Bee

(57) ABSTRACT

A miniature life-saving device for an emergency situation is disclosed. The device, for example, is useful for a trapped person under a mound of debris created by a fallen building during an earthquake or a terrorist attack. The device comprises a communication unit, a sensory unit and a power supply system. The power supply system may be a battery. The power supply system may also be a kinetic-to-electrical-energy converter. The device may be embedded in a person's clothes or accessories. The device may be operated in an extremely low power mode in a sustaining mode of operation for receiving an external signal only. The sensory unit, comprising an accelerometer/gyroscope and/or an infrared/temperature sensor, measures the survivability of the person and transmits the measured data to an external rescue station after receiving an authorized signal. The device may also be operated collaboratively with a handheld electronic device.

18 Claims, 7 Drawing Sheets

MINIATURE LIFE-SAVING DEVICE

CROSS-REFERENCE TO RELATED APPLICATIONS

This application is related to application Ser. Nos. 12/344,519 and 12/508,611.

BACKGROUND

1. Field of Invention

This invention relates to a sensing and communicating device, specifically to a miniature device for determining location and survivability of a person under a disaster situation.

2. Description of Prior Art

A person may encounter many different dangerous situations during his or her life. For example, a person may be trapped under a mound of debris created by a fallen building during an earthquake or a terrorist attack. A rescue team is sent to fallen building to search for survivors. It is important for the rescue team to identify the location and status of the trapped person to save the person's life effectively. Although a mobile phone is becoming a popular handheld device, it may not be an effective communication device under a disaster situation. For example, the communication network may be destroyed during an earthquake. Further, a rescue task may take more than 1-2 weeks for a disaster such as an earthquake. The battery of the mobile phone may run out of power in a couple of days for most of devices.

Therefore, it is desirable to have a device carried by a person, which can be used in an emergency situation to communicate with an external rescue station operated by a rescue team. The device should be tiny in its form factor and therefore it can be embedded in the person's clothes or accessories without notification of the person in a normal daily life. The device should also be operated under an extremely low power consumption mode and therefore it is not necessary to replace its power supply or the device itself during a reasonable long operation lifetime of the device.

SUMMARY OF THE INVENTION

According to one embodiment of the present invention, the life-saving device is an electronic device in a standalone form. The device comprises a sensory unit, a processor, a data storage unit, a communication unit and a power supply system. According to one aspect of the present invention, the sensory unit may comprise an accelerometer and/or a gyroscope. According to another aspect of the present invention, the sensory unit may comprise an infrared sensor and/or a temperature sensor. In a sustaining mode, the device is operated under an extremely low power mode with the communication unit as a receiver only. All other functional blocks which are not required for the operation are switched off. In an emergency situation, a rescue station sends an authorized signal to the device to trigger the operation of sensory unit and other functional blocks. The sensory unit collects the data and the device transmits a data file including data collected from the sensory unit to the rescue station through an ad hoc communication network. The data file may also include location of the person determined from a GPS (Global Positioning System) and the identity of the person pre-stored in the data storage unit. The rescue team determines the survivability status and the location of the person based upon the received data.

According to another embodiment, the device is attachable to a handheld electronic device such as for example, a mobile phone. The power supply system may be a battery which is re-chargeable by a power supply of the mobile phone.

BRIEF DESCRIPTION OF THE DRAWINGS

For a more complete understanding of the present invention and its various embodiments, and the advantages thereof, reference is now made to the following description taken in conjunction with the accompanying drawings, in which.

DETAILED DESCRIPTION

The present invention will now be described in detail with references to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

Figure 1:
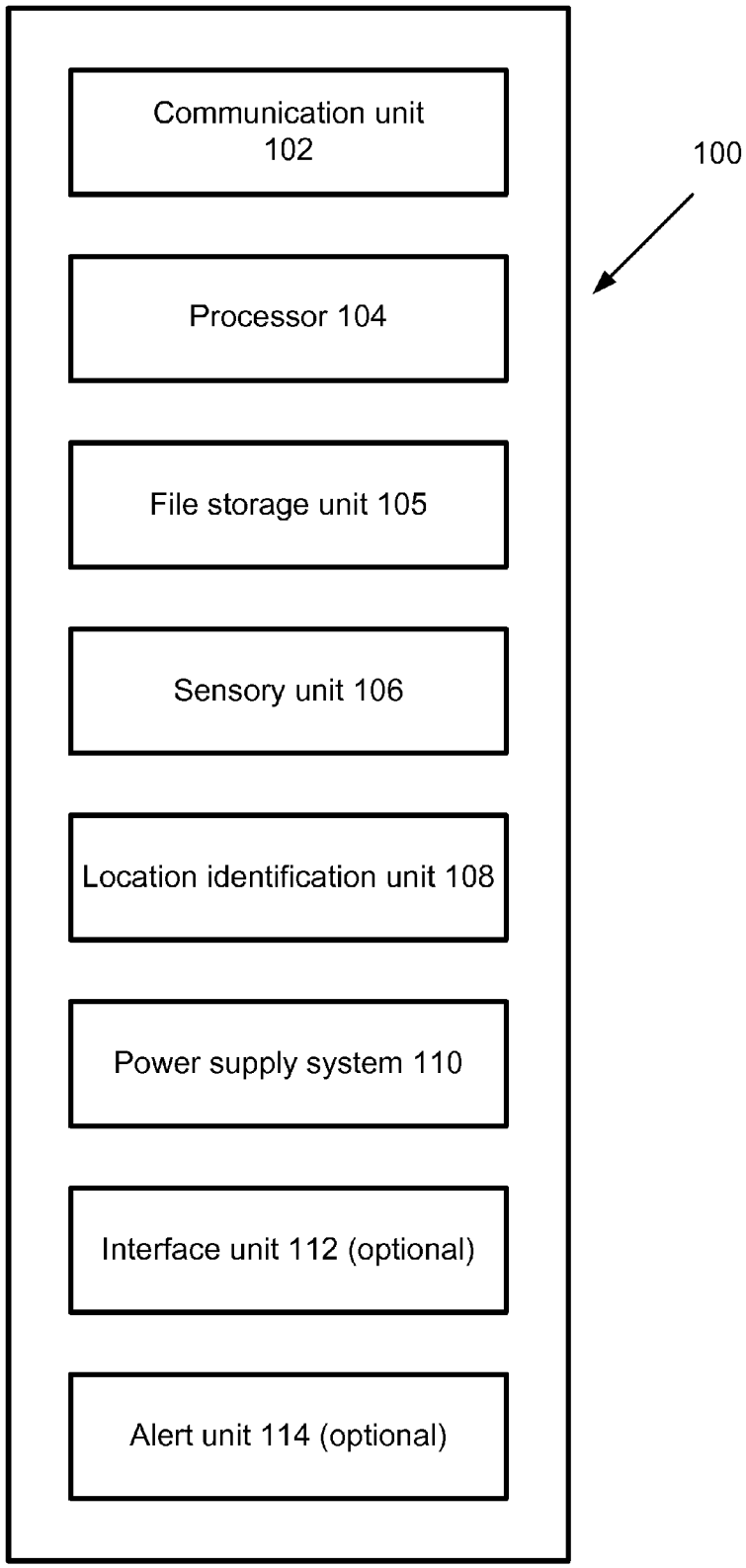
FIG. 1 is a schematic diagram of a life-saving device illustrating the present invention.

FIG. 1 is a schematic diagram of a life-saving device 100 as an illustration of the present invention. The device 100 includes a communication unit 102. According to one implementation, 102 is a short range communication device. It may form an ad hoc communication network with other similar devices. The communication unit 102 comprises a transceiver conforming to the ZigBee protocol in the preferred embodiment. ZigBee is the name of a specification for a suite of high level communication protocols using small, low-power digital radios based on the IEEE 802.15.4 standard for wireless personal area network (WPANs). The technology is intended to be simpler and less expensive than other WPANs, such as Bluetooth (IEEE 802.11b). ZigBee is targeted at radio frequency (RF) applications that require a low data rate, long battery life, and secure networking. The unit may also conform to other standards such as for example, the Bluetooth (IEEE 802.11), the WiFi (IEEE 802.11n) and the active RFID.

A processor 104 is employed to control operations of the device. The processor 104 may be a low power microprocessor or controller. A file storage unit 105 is employed for storing data. The person's identity may be pre-stored in the storage unit.

A sensory unit 106 is used to determine the survivability of a person in an emergency situation such as when the person is trapped in a mound of debris of a fallen building. According to one aspect of the present invention, the sensory unit 106 may comprise an accelerometer and/or a gyroscope. The accelerometer and/or the gyroscope can detect motion of the device induced by the carrying person. In an exemplary case, the device is embedded in a sleeve of a garment of the person. When the person moves his or her arm, the accelerometer and/or the gyroscope detects a signal. The signal indicates the person is still alive. The sensory unit 106 may also comprise an infrared and/or a temperature sensor for detecting a body temperature of the person. The survivability of the person may be determined by analyzing the data collected from the sensory unit.

The device 100 may further comprise a location identification unit 108 providing a means for determining the location of the person in emergency situation. The unit 108 may be a GPS (Global Positioning System). The location of the person may also be determined by a zonal method based upon an ad hoc network formed by multiple device including ZigBee transceivers. A power supply unit 110 is used to power the operation of the device. The power supply unit may include a battery. The power supply unit may further include a power management unit. When the device 100 is operated in a sustaining mode, the communication unit 102 is operated as a receiver to save the power consumption. After receiving an authorized signal from the external station, the processor 104 switches on all functional blocks of the device 100 for collecting survivability data and for transmitting the collected data to the external station. The transmitted data may also include other information such as the person's location collected from the location identification unit 108 and the person's identity pre-stored in the storage unit 105. The power supply unit 110 may also include a kinetic-to-electrical-energy converter for converting the kinetic energy generated from the person's motion to the electrical energy.

According to one embodiment of the present invention, the device is contained in a single case and is operated in a standalone manner. The device may be embedded in the person's clothes or accessories including shoes, hat, belt, rings, ear-rings, necklace and eyeglass.

According to another embodiment, the device 100 may be operated in collaboration with another handheld electronic device. An interface unit 112 is required to connect the device 100 to the handheld electronic device.

The device 100 may include optionally an alert unit 114. The unit may comprise a buzz and vibration generator. After the authorized signal from the external rescue station is received by the communication unit 102, the processor 104 controls an operation to deliver a buzz and/or a vibration signal to alter the person. The person being alerted may generate a motion intentionally to send a signal about his or her survival status to the rescue station.

Figure 2:
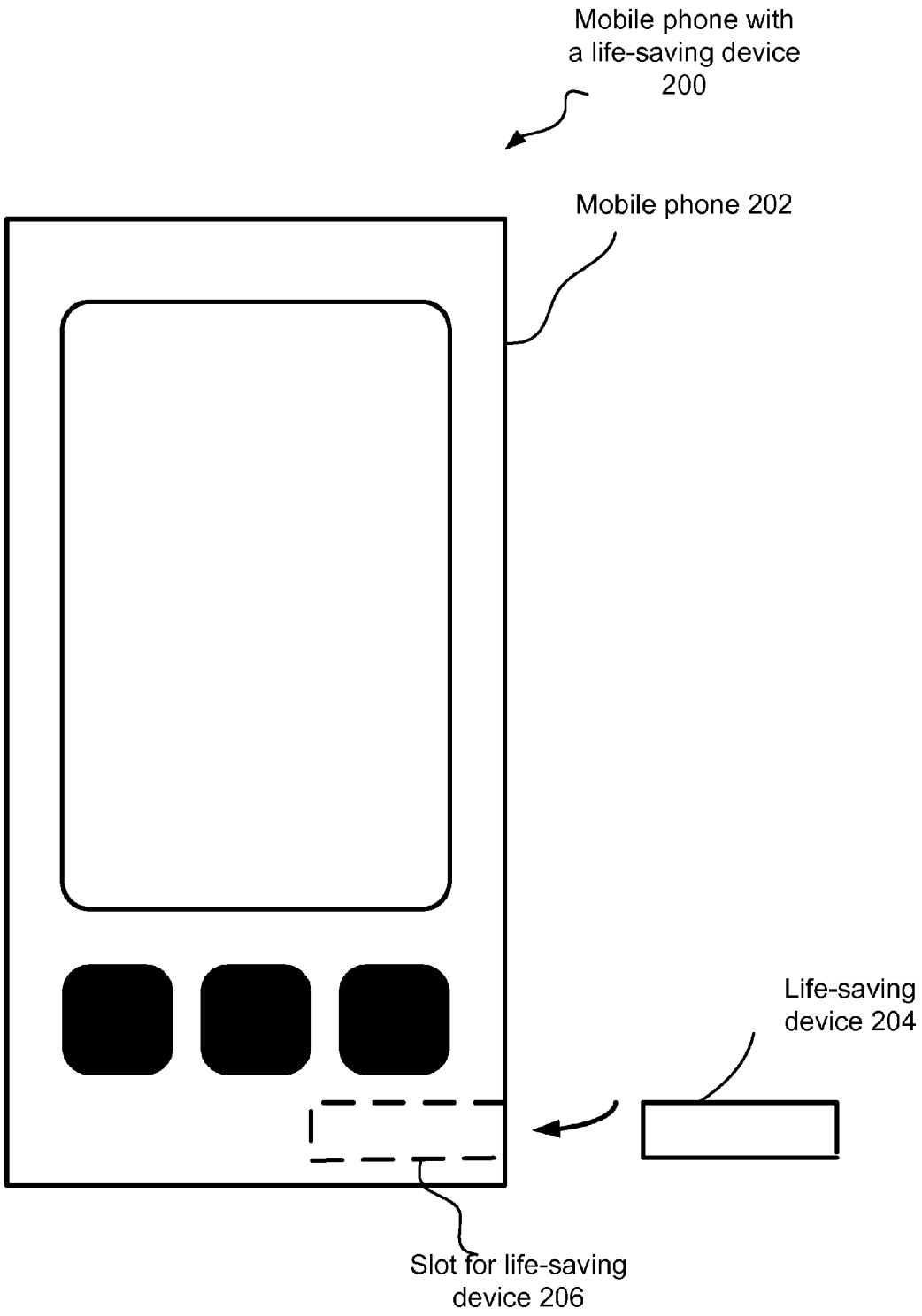
FIG. 2 is a schematic diagram of a life-saving device detachable to a handheld electronic device.

FIG. 2 is a schematic diagram of another embodiment of the life-saving device which is detachable to a handheld electronic device. An exemplary device 200 comprising a mobile phone 202 and the life-saving device 204 is illustrated in the figure. The mobile phone 202 includes an open slot 206. According to the preferred embodiment, when the device 204 is plugged into the slot 206, the battery of the device 204 may be charged by the battery of the mobile phone 202. The device 204, as an external device to the mobile phone 202, may be managed by the processor of the mobile phone. For example, the data can be exchanged in-between the mobile phone 202 and the life-saving device 204 through a connector such as for example, the USB (Universal Serial Bus). According to another implementation, the mobile phone 202 may only be used as a carrier for the life-saving device 204. There may be no electrical power exchange in-between two devices. The data may be exchanged through a short range wireless communication means such as through the ZigBee transceivers in the life-saving device 204 and in the mobile phone 202.

Figure 3:
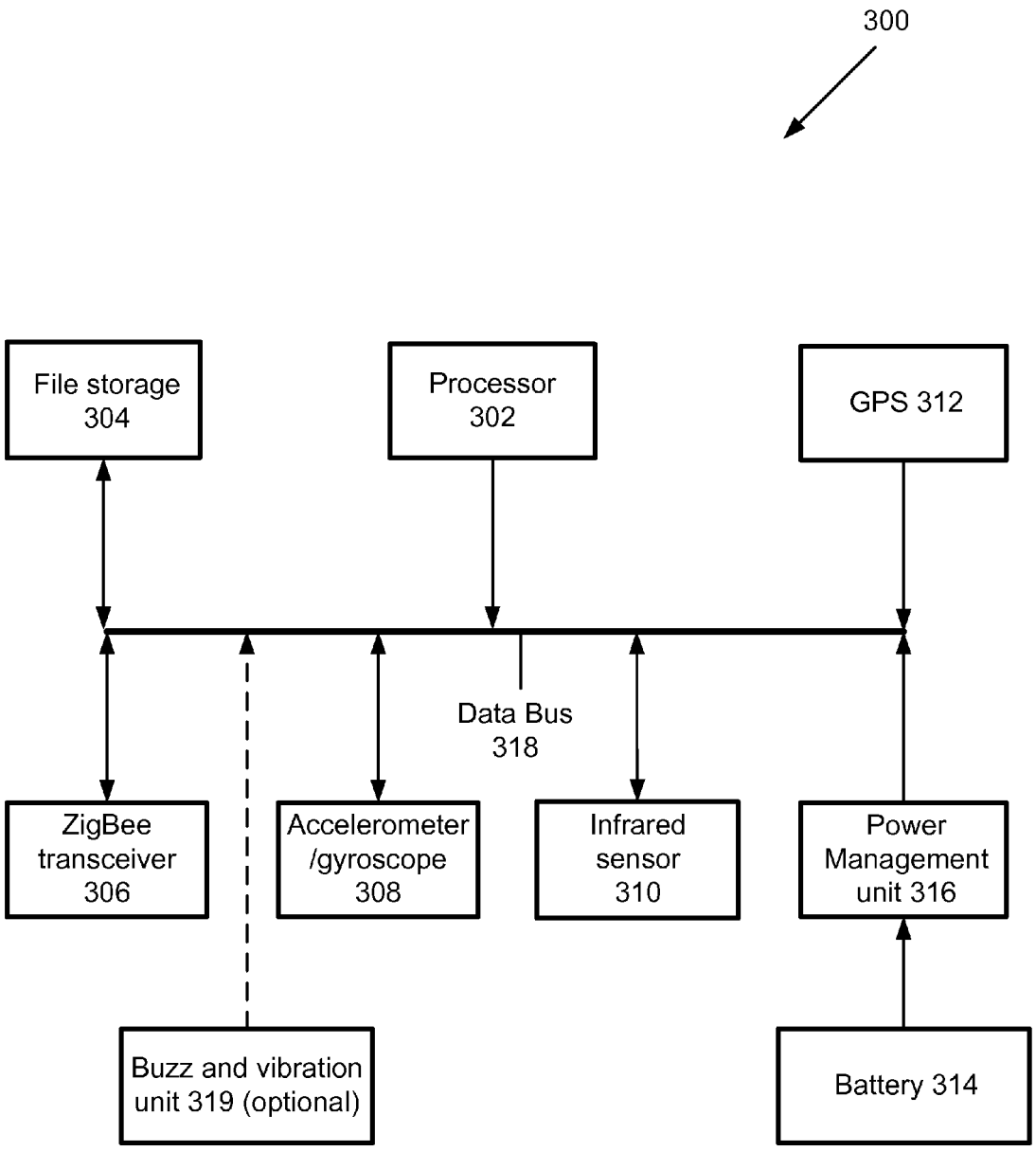
FIG. 3 is a schematic functional block diagram of one embodiment of the life-saving device using a battery as the power supply system.

An exemplary illustration of the life-saving device 100 is shown in FIG. 3. The exemplary device 300 includes a processor 302 that pertains to a microprocessor or a controller for controlling the overall operation of the life-saving device 300. The processor may also include a DSP (Digital Signal Processor). The file storage unit 304 is, typically, a flash memory or a plurality of flash memories. The file storage unit 304 may also include a cache, for example, a Random-Access Memory (RAM) provided by semiconductor memory. The relative access time to the cache is substantially shorter than for the Flash memories.

The device 300 further includes a transceiver 306 that is taken as a ZigBee transceiver as an exemplary case as shown in the figure. ZigBee is targeted at radio frequency (RF) applications that require a low data rate, long battery life, and secure networking.

The sensory unit of the exemplary device 300 further comprises an accelerometer and/or a gyroscope 308 and an infrared sensor and/or a temperature sensor 310. Silicon based accelerometers and/or gyroscopes have been used in many mobile devices to enhance its functionality such as in iPhone from Apple Inc. The cost of the accelerometer and/or gyroscope has been in decreasing path in recent years. The infrared sensor and the temperature sensor 310 may be employed to detect body temperature of a human body nearby or in touch with the sensors and to determine the survival status of the person. It should be noted that the accelerometer/gyroscope and/or the infrared/temperature sensors may used independently or in collaboration to determine the survivability status of the person in the emergency situation.

The life-saving device 300 may also include a GPS unit 312 as an option to determine the location of the person. Alternatively, the location can be determined by a zonal method for an ad hoc network formed by the multiple ZigBee devices.

According to one implementation of the present invention, the power supply system of the exemplary life-saving device 300 is a battery 314. The battery may be re-chargeable. The power supply of the device 300 is managed by the power management unit 316.

The device 300 may include a data bus 318 for exchanging data among different functional blocks of the device.

The device 300 may further include a buzz and/or vibration unit 319 as an option. After the ZigBee transceiver receives the authorized signal from the external rescue station, a buzz and/or vibration signal is delivered to the person. The person, being alerted, may generate intentionally a motion to deliver a signal to the rescue station about his or her survival status through the accelerometer and/or gyroscope.

Figure 4:
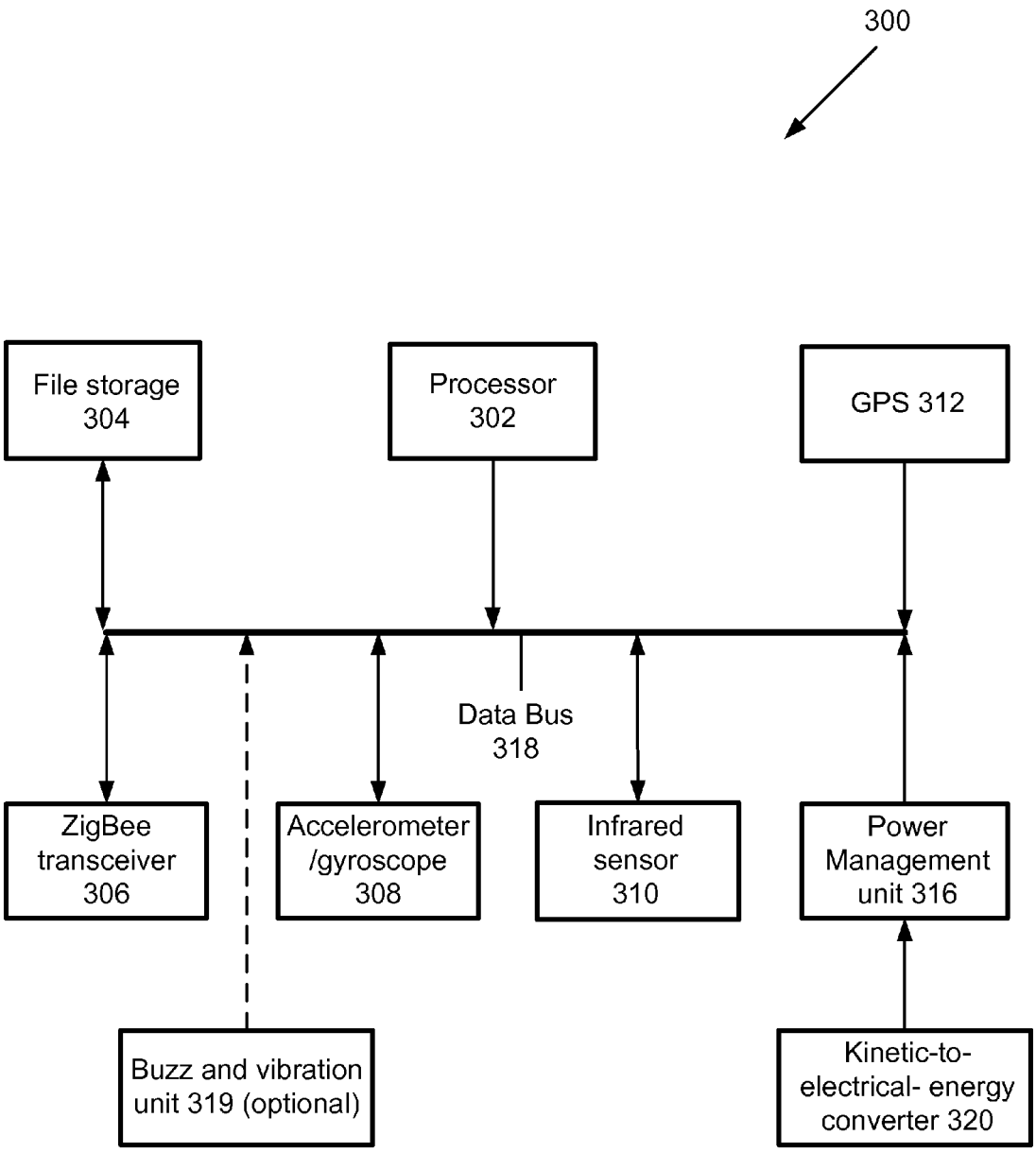
FIG. 4 is a schematic functional block diagram of one embodiment of the life-saving device using a kinetic-energy-to-electrical-energy converter as the power supply system.

According to another implementation of the present invention as illustrated in FIG. 4, the power supply system is a kinetic-energy-to-electrical-energy converter 320. In one exemplary case, the converter 320 may comprise a coil and a magnet with the movement of the movable user interface element causing the magnet to pass near or through the coil or causing the coil to pass near or over the magnet. In another exemplary case, the converter 320 may comprise a piezoelectric device that generates electrical power through an induced strain or pressure. The converter 320 further comprises a rectifier and a capacitor or a battery for storing the generated electrical power.

Figure 5:
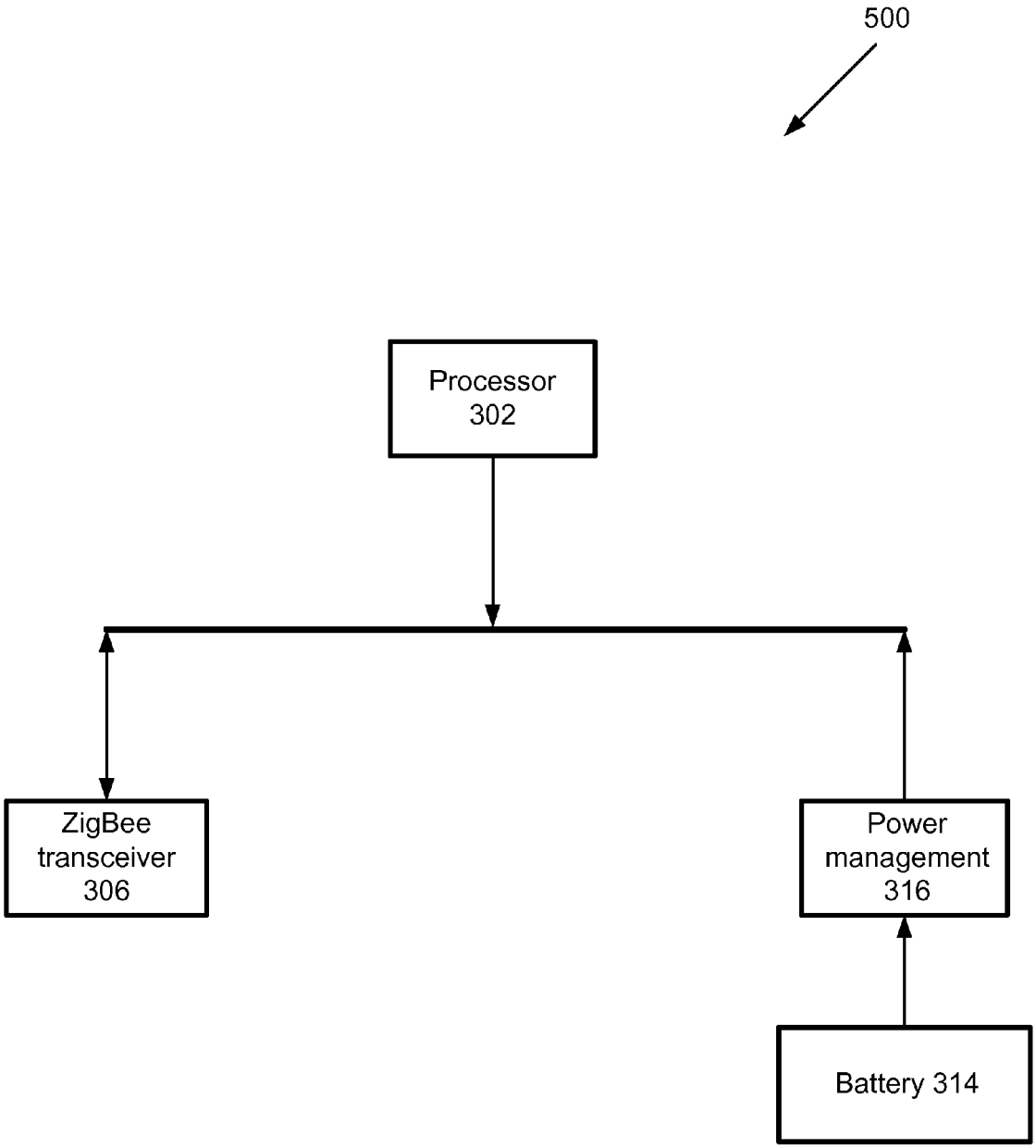
FIG. 5 is a schematic functional block diagram of the life-saving device operated under an extremely low power mode with the communication unit as a receiver only.

FIG. 5 is a schematic functional block diagram of the exemplary life-saving device 300 operated in an extremely low power mode with the communication unit as a receiver only in a sustaining mode of operation of the device. The file storage unit 304, the sensory units 308 and 310 and the GPS unit 312 are switched off by the processor 302. The processor 302 may be operated in a low power mode. The ZigBee transceiver 306 is operated as the receiver only to save the power consumption before the authorized signal from an external rescue station is received.

After the authorized signal is received by the ZigBee transceiver 306, all function blocks including file storage unit 304, the accelerometer/gyroscope 308, the infrared sensor/temperature sensor 310 and the GPS unit 312 are switched on. The GPS unit 312 is not required if the location of the person is determined by the zonal method. The authorized signal may be sent from a mobile rescue station comprising a communication device conforming also to the ZigBee standard. The permission of delivery of the authorized signal may only be granted by a government agency. It can only be used, for example, in emergency situations such as in a nature disaster or under a terrorist attack. It may be a software key to unlock the life-saving device to operate as the emergency communication and data collection device.

After receiving the authorized signal, the processor 302 sends a command to switch on all other functional blocks of the device. The accelerometer/gyroscope 308 receives a signal if the person induces a motion of the device. The infrared sensor 310 receives radiation from the person and generates a corresponding signal indicating the survivability status of the person. The temperature sensor if used may collect the person's body temperature when the sensor and the body are in contact in at least some implementations of the present invention. The collected signals are then transmitted back to the mobile rescue station for analyzing the status of the person. In the same time, the person's identity and/or other personal data may also be read out from the file storage unit and be sent to the rescue station.

Figure 6:
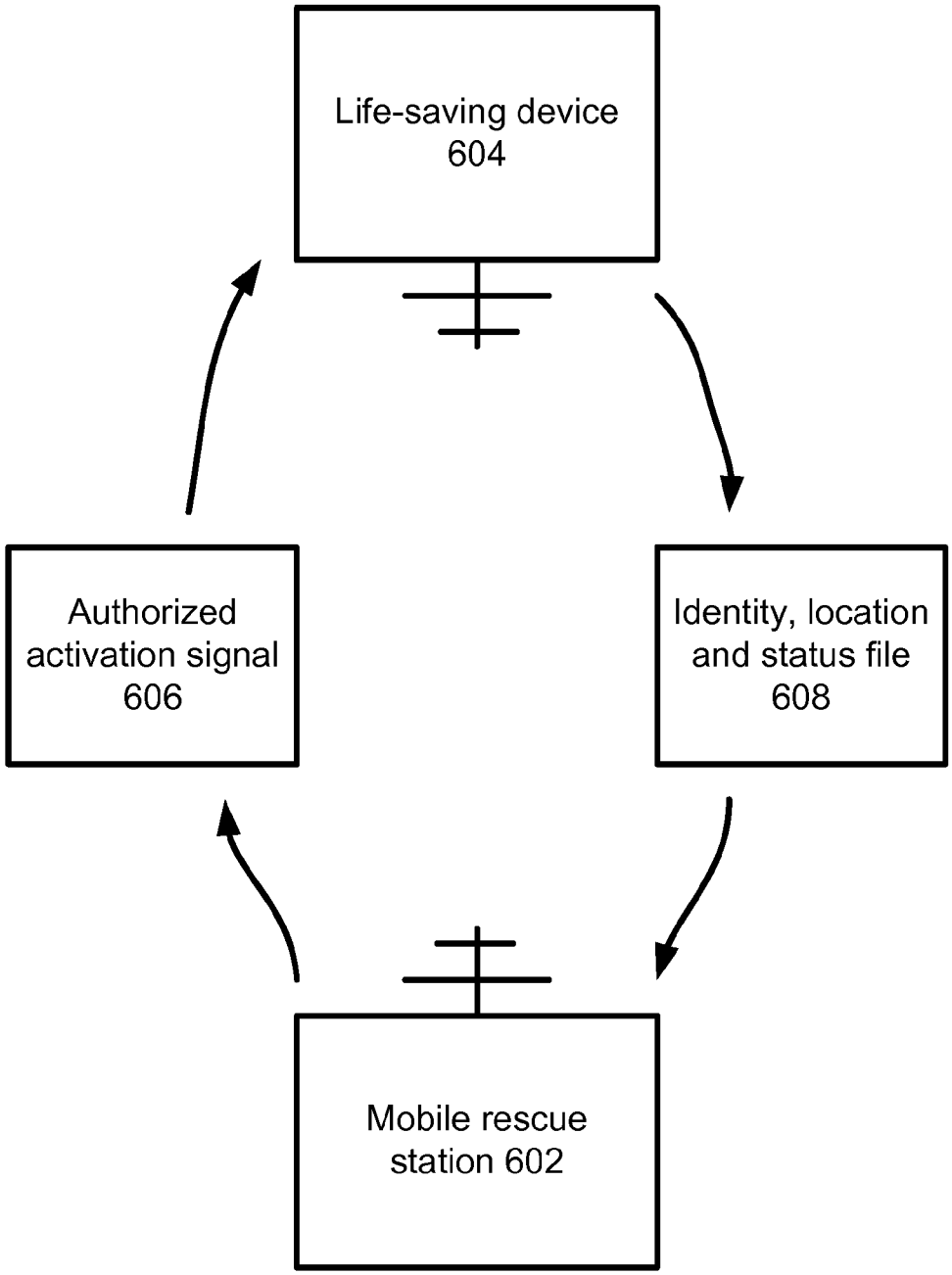
FIG. 6 shows a schematic diagram that the mobile rescue station sends an authorized signal to the life-saving device and triggers the operation of the device collecting survivability status of the person and transmitting the collected data to the rescue station.

The interaction between the mobile rescue station 602 and the life-saving device 604 is further illustrated in FIG. 6. The mobile rescue station 602 sends the authorized signal 606 to the life-saving device 604. The life-saving device 604 then sends back a file 608 to the rescue station 602 which may comprise the person's identity, the person's survival status represented by the signals collected from the sensory unit and the location detected from the GPS (optional). Although one rescue station and one life-saving device are shown in the figure, the inventive concept can be extended to multiple life-saving devices and multiple rescue stations. In the case that the zonal method is used to determine the person's location, multiple disposable communication devices including ZigBee transceivers may be used to form existing nodes of the ad hoc network. Locations of the persons in the emergency situation associated with the respective life-saving devices including ZigBee transceivers may be determined based upon their relationship with the existing nodes.

Figure 7:
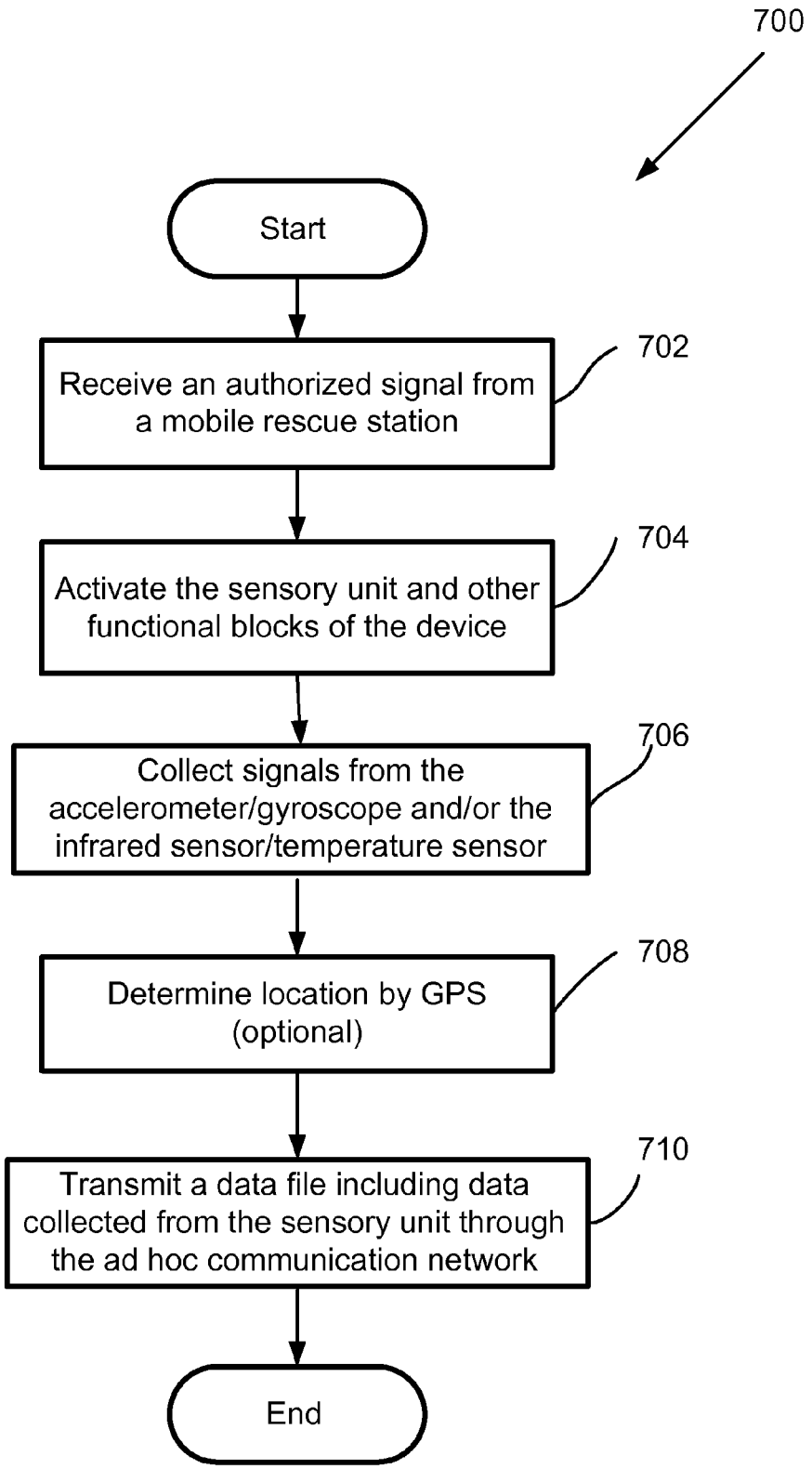
FIG. 7 shows a flow diagram of the operation that the life-saving device is used to collect the status of the person in the emergency situation and to communicate with the mobile rescue station.

FIG. 7 shows a flow diagram for a process 700 that the mobile rescue station 602 communicates with the life-saving device 604. The process begins with a step 702 that the authorized signal is received by the life-saving device 604 from the mobile rescue station 602. After receiving the signal, the life-saving device 604 activates the emergency functions by switching on all functional blocks in step 704. The processor of the device may also send an instruction to deliver a buzz and vibration signal to the person (not shown in the process 700). In step 706, the signals from the accelerometer/gyroscope and/or the signals from the infrared/temperature sensor are collected. The person's location may be determined in step 708 by the GPS. Alternatively, the location may be determined by the zonal method. In step 710, the person's identity which is read out from the storage unit of the life-saving device, the location measured by GPS (optional) and the survival status information collected by the sensory unit are transmitted to the mobile rescue station 602 through the ad hoc communication network.

The invention claimed is:

1. A miniature electronic device for communicating survivability status of a person in an emergency situation, the device comprising:

a. a communication unit;

b. a motion sensor; and c. a power supply, wherein said device comprising:

i. a first operation mode in a sustaining mode, wherein electrical power is supplied from the power supply to the communication unit for receiving an external authorized signal from an external device; and ii. a second operation mode in an emergency situation, wherein the electrical power is supplied from the power supply to the motion sensor and to the communication unit for transmitting a data file including data collected by the motion sensor after receiving the authorized signal from the external device.

2. The device as recited in claim 1, wherein said motion sensor further comprising an accelerometer or a gyroscope for detecting motion of said device induced by the person.

3. The device as recited in claim 1, wherein said device further comprising an infrared sensor for detecting infrared radiation from the person.

4. The device as recited in claim 1, wherein said device further comprising a processor.

5. The device as recited in claim 1, wherein said device may be contained in a single case and be embedded in a person's clothes or accessories including shoes, hat, belt, ring, earring, eyeglass, and necklace.

6. The device as recited in claim 1, wherein said power supply is a kinetic-energy-to-electrical-energy converter.

7. The device as recited in claim 1, wherein said device further comprising a GPS (Global Positioning System) for determining the location of said device.

8. The device as recited in claim 1, wherein said communication unit is employed to form a node of an ad hoc communication network.

9. The device as recited in claim 1, wherein said device further comprising an audio alerting unit for delivering an audio signal after the device receives the authorized signal.

10. The device as recited in claim 1, wherein said device is a detachable part of a handheld electronic device.

11. A miniature electronic device for communicating survivability status of a person in an emergency situation, the device comprising:

a. a communication unit;

b. a motion sensor; and c. a power supply including a kinetic energy to electrical energy converter, wherein said device comprising:

i. a first operation mode in a sustaining mode, wherein electrical power is supplied from the power supply to the communication unit for receiving an external authorized signal from an external device; and ii. a second operation mode in an emergency situation, wherein the electrical power is supplied from the power supply to the motion sensor and to the communication unit for transmitting a data file including data collected by the motion sensor after receiving the authorized signal from the external device.

12. The device as recited in claim 11, wherein said motion sensor further comprising an accelerometer or a gyroscope for detecting motion of said device induced by the person.

13. The device as recited in claim 11, wherein said device further comprising an infrared sensor for detecting infrared radiation from the person.

14. A method of communication between a miniature life-saving device associated with a person and a mobile rescue station associated with a rescue team, wherein the life-saving device comprising a communication unit for communicating through an ad hoc communication network, a motion sensor for detecting survivability of the person, a power supply system and a data storage unit, the method comprising at least the following sequential steps:

a. operating said communication unit under a low power mode as a receiver;

b. receiving an authorized signal from the mobile rescue station;

c. switching on the motion sensor;

d. collecting signals generated from the motion sensor; and e. transmitting a data file including the data collected from the motion sensor through the ad hoc communication network.

15. The method as recited in claim 14, wherein said life-saving device further comprising an infrared sensor.

16. The method as recited in claim 14, wherein said life-saving device further providing a means of determining its location including employing a GPS (Global Positioning System).

17. The method as recited in claim 14, wherein said life-saving device further providing a means of determining its location through a zonal method based upon an ad hoc network comprising a plurality of devices including the short range communication transceivers conforming to the same standard (s).

18. The method as recited in claim 14, wherein said method further comprising a step of delivering a buzz or a vibration to the person through an alerting unit of the device.

* * * * *